US008608276B2

(12) United States Patent
Oohashi et al.

(10) Patent No.: US 8,608,276 B2
(45) Date of Patent: Dec. 17, 2013

(54) LIQUID DISCHARGE HEAD AND INK JET RECORDING APPARATUS INCLUDING LIQUID DISCHARGE HEAD

(75) Inventors: Ryoji Oohashi, Yokohama (JP); Yoshiyuki Imanaka, Kawasaki (JP); Kazunori Masuda, Asaka (JP); Daishiro Sekijima, Kawasaki (JP); Takashi Aoki, Urayasu (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 13/096,385

(22) Filed: Apr. 28, 2011

(65) Prior Publication Data

US 2011/0292112 A1 Dec. 1, 2011

(30) Foreign Application Priority Data

May 31, 2010 (JP) ..... 2010-125113

(51) Int. Cl.
*B41J 29/393* (2006.01)

(52) U.S. Cl.
USPC ..... 347/19; 347/185

(58) Field of Classification Search
USPC ..... 347/11, 14, 17, 60, 185, 19
See application file for complete search history.

(56) References Cited

U.S. PATENT DOCUMENTS

| | | | | |
|---|---|---|---|---|
| 4,791,437 | A | | 12/1988 | Accattino et al. |
| 4,901,095 | A | * | 2/1990 | Perra et al. ..... 347/20 |
| 5,731,828 | A | | 3/1998 | Ishinaga et al. |
| 5,847,356 | A | | 12/1998 | Santhanam |
| 5,850,238 | A | | 12/1998 | Karita et al. |
| 5,880,762 | A | | 3/1999 | Ishinaga et al. |
| 5,943,070 | A | | 8/1999 | Kamiyama et al. |
| 6,003,973 | A | | 12/1999 | Kamiyama et al. |
| 6,054,689 | A | | 4/2000 | Imanaka et al. |
| 6,062,678 | A | | 5/2000 | Ishinaga et al. |
| 6,074,041 | A | | 6/2000 | Imanaka et al. |
| 6,116,714 | A | | 9/2000 | Imanaka et al. |
| 6,130,692 | A | | 10/2000 | Mochizuki et al. |
| 6,224,184 | B1 | | 5/2001 | Imanaka et al. |

(Continued)

FOREIGN PATENT DOCUMENTS

| | | |
|---|---|---|
| CN | 1104151 A | 6/1995 |
| JP | 07-290710 A | 11/1995 |

(Continued)

OTHER PUBLICATIONS

Notification of the First Office Action dated May 29, 2013, in Chinese Application No. 201110138099.8.

(Continued)

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

A liquid discharge head includes a heat generating element which generates heat energy used to discharge a liquid; a temperature detecting element which changes in output voltage in response to a change in the temperature of the heat generating element; an electrical power source line and a grounding line electrically connected to each other through the heat generating element to apply a current to the heat generating element; and a pair of lines for temperature detection electrically connected to each other through the temperature detecting element to apply a current to the temperature detecting element. Here, each of the pair of lines for temperature detection is arranged adjacent to the other.

9 Claims, 6 Drawing Sheets

(56) References Cited

U.S. PATENT DOCUMENTS

| | | | |
|---|---|---|---|
| 6,224,195 | B1 | 5/2001 | Maru et al. |
| 6,243,111 | B1 | 6/2001 | Imanaka et al. |
| 6,257,695 | B1 | 7/2001 | Kamiyama et al. |
| 6,293,655 | B1 | 9/2001 | Imanaka et al. |
| 6,302,504 | B1 | 10/2001 | Imanaka et al. |
| 6,380,511 | B1 | 4/2002 | Santhanam |
| 6,382,772 | B1 | 5/2002 | Kamiyama et al. |
| 6,409,300 | B2 | 6/2002 | Imanaka et al. |
| 6,439,680 | B1 | 8/2002 | Mochizuki et al. |
| 6,439,690 | B2 | 8/2002 | Ishinaga et al. |
| 6,443,563 | B1 | 9/2002 | Saito et al. |
| 6,454,379 | B1 | 9/2002 | Taneya et al. |
| 6,464,320 | B1 | 10/2002 | Maru et al. |
| 6,467,863 | B1 | 10/2002 | Imanaka et al. |
| 6,513,911 | B1 | 2/2003 | Ozaki et al. |
| 6,578,951 | B2 | 6/2003 | Ozaki et al. |
| 6,616,257 | B2 | 9/2003 | Imanaka et al. |
| 6,688,729 | B1 | 2/2004 | Imanaka et al. |
| 6,712,437 | B2 | 3/2004 | Furukawa et al. |
| 6,769,754 | B2 | 8/2004 | Imanaka et al. |
| 6,773,096 | B2 | 8/2004 | Mochizuki et al. |
| 6,787,710 | B2 | 9/2004 | Uematsu et al. |
| 6,824,237 | B2 | 11/2004 | Hirayama et al. |
| 6,945,629 | B2 | 9/2005 | Yamaguchi et al. |
| 6,945,633 | B2 | 9/2005 | Imanaka et al. |
| 6,969,154 | B2 | 11/2005 | Takeuchi et al. |
| 7,055,923 | B2 | 6/2006 | Mochizuki et al. |
| 7,108,345 | B2 | 9/2006 | Mochizuki et al. |
| 7,216,960 | B2 | 5/2007 | Imanaka et al. |
| 7,290,848 | B2 | 11/2007 | Masuda |
| 7,309,120 | B2 | 12/2007 | Hatsui et al. |
| 7,344,218 | B2 | 3/2008 | Imanaka et al. |
| 7,364,284 | B2 | 4/2008 | Hatsui et al. |
| 7,467,864 | B2 | 12/2008 | Matsui et al. |
| 7,549,734 | B2 | 6/2009 | Imanaka et al. |
| 7,575,294 | B2 | 8/2009 | Imanaka et al. |
| 7,581,821 | B2 | 9/2009 | Hatsui et al. |
| 7,588,317 | B2 | 9/2009 | Imanaka et al. |
| 7,591,538 | B2 | 9/2009 | Toge et al. |
| 7,600,836 | B2 | 10/2009 | Masuda |
| 7,621,612 | B2 | 11/2009 | Yamaguchi et al. |
| 7,722,148 | B2 | 5/2010 | Takabayashi et al. |
| 7,841,678 | B2 | 11/2010 | Imanaka et al. |
| 7,896,475 | B2 | 3/2011 | Omata et al. |
| 7,918,539 | B2 | 4/2011 | Imanaka et al. |
| 7,950,765 | B2 | 5/2011 | Takabayashi et al. |
| 2005/0179745 | A1* | 8/2005 | Yamaguchi et al. ..... 347/67 |
| 2007/0229566 | A1* | 10/2007 | Takabayashi et al. ..... 347/17 |
| 2008/0024534 | A1 | 1/2008 | Imanaka et al. |
| 2009/0295874 | A1 | 12/2009 | Toge et al. |
| 2011/0032295 | A1 | 2/2011 | Imanaka et al. |

FOREIGN PATENT DOCUMENTS

| | | | |
|---|---|---|---|
| JP | 09-174847 | A | 7/1997 |
| JP | 10-085965 | A | 4/1998 |
| JP | 2000-127400 | A | 5/2000 |
| JP | 2001-127400 | A | 5/2001 |
| JP | 2002-353588 | A | 12/2002 |
| JP | 2004-50637 | A | 2/2004 |
| JP | 2008-235578 | A | 10/2008 |
| JP | 2010-036454 | A | 2/2010 |

OTHER PUBLICATIONS

Decision of Refusal mailed Mar. 19, 2013, in Japanese Application No. 2010-125113.

Office Action dated Aug. 9, 2013, in Korean Application No. 10-2011-0048849.

* cited by examiner

LIQUID DISCHARGE HEAD AND INK JET RECORDING APPARATUS INCLUDING LIQUID DISCHARGE HEAD

BACKGROUND OF THE INVENTION

1. Field of the Invention

The present invention relates to a liquid discharge head which discharges liquids, such as ink, and an ink jet recording apparatus including the liquid discharge head.

2. Description of the Related Art

As liquid discharge heads provided in an ink jet recording apparatus, there is a liquid discharge head in which a heat generating element (heater) and its driving circuit, and line which connects the heat generating element and the driving circuit are formed on the same substrate, using a semiconductor processing technique. Moreover, there is also a liquid discharge head in which a temperature detecting element which is close to a heat generating element and in which an output voltage changes in response to the temperature change of the heat generating element is formed.

In ink jet recording apparatuses including the above liquid discharge heads, in order to increase the speed of recording operation, the number of heat generating elements to be formed on a substrate tends to increase. This is because, as the number of heat generating elements increases, the number of discharge ports provided to face the heat generating elements also increases, and consequently, it is possible to discharge a large amount of ink at one time. However, in a case where a current is simultaneously applied to a number of heat generating elements, a pulsed large current (a current of about 1 A to several amperes) flows to an electrical power source line and grounding line. As such a pulsed large current flows, noise caused by inductive coupling may be generated in a signal line of the above driving circuit. In this case, there is a concern that the driving circuit may malfunction due to the noise.

Thus, a liquid discharge head for solving such a problem is disclosed in Japanese Patent Application Laid-Open No. 2000-127400. In the liquid discharge head disclosed in Japanese Patent Application Laid-Open No. 2000-127400, the laying of a signal line which is easily influenced by noise is suppressed to the minimum by arranging a driving circuit (signal processing circuit) at a corner portion of a substrate.

In the ink jet recording apparatus, conventionally, temperature detection (current application of a temperature detecting element) of a heat generating element is performed while a current is not applied to the heat generating element, that is, during non-recording. However, in recent years, performing temperature detection during recording has been required in order to further increase the speed of a recording operation. This is because, by performing recording while performing temperature detection, it is possible to assign the time for the temperature detection spent during non-recording to other processes. However, in a case where temperature detection is performed during recording, as described above, a pulsed large current flows to the electrical power source line and grounding line for applying a current to the heat generating element. Therefore, it is assumed that noise is generated in an electrical line for applying a current to the temperature detecting element. In this case, there is a concern that the output voltage of the temperature detecting element may be influenced by noise, and the temperature of the heat generating element may be erroneously detected. In addition, although Japanese Patent Application Laid-Open No. 2000-127400 discloses a technique in which a driving circuit is not easily influenced by noise, a technique of coping with erroneous detection of the temperature of the heat generating element described above is not disclosed.

SUMMARY OF THE INVENTION

Thus, the object of the invention is to provide a liquid discharge head capable of detecting temperature, which is not easily influenced by noise even during recording, and an ink jet recording apparatus including the liquid discharge head.

In order to achieve the above object, there is provided a liquid discharge head including a heat generating element which generates heat energy used to discharge a liquid; a temperature detecting element which changes in output voltage in response to a change in the temperature of the heat generating element; an electrical power source line and a grounding line electrically connected to each other through the heat generating element to apply a current to the heat generating element; and a pair of lines for temperature detection electrically connected to each other through the temperature detecting element to apply a current to the temperature detecting element. Here, each of the pair of lines for temperature detection is arranged adjacent to the other.

According to the above configuration, each of the pair of lines for temperature detection for applying the second current to the temperature detecting element is arranged adjacent to the other. Therefore, when the first current is fed to the heat generating element while feeding the second current to the temperature detecting element regularly, each of the pair of lines for temperature detection receives the noise emitted from the electrical power source line and the grounding line in the same environment (positions) as each other. At this time, since noise currents which flow through the pair of lines for temperature detection, respectively, have reverse phases as seen from the temperature detecting element, these noise currents are mutually cancelled out. Therefore, the noise currents generated in the pair of lines for temperature detection during current application of both the temperature detecting element and the heat generating element are suppressed. Thereby, temperature detection which is not easily influenced by noise even during recording is possible, and it is possible to further increase the speed of recording operation.

Further features of the present invention will become apparent from the following description of exemplary embodiments with reference to the attached drawings.

DESCRIPTION OF THE EMBODIMENTS

An exemplary embodiment of the present invention will now be described in detail in accordance with the accompanying drawings.

Figure 1:
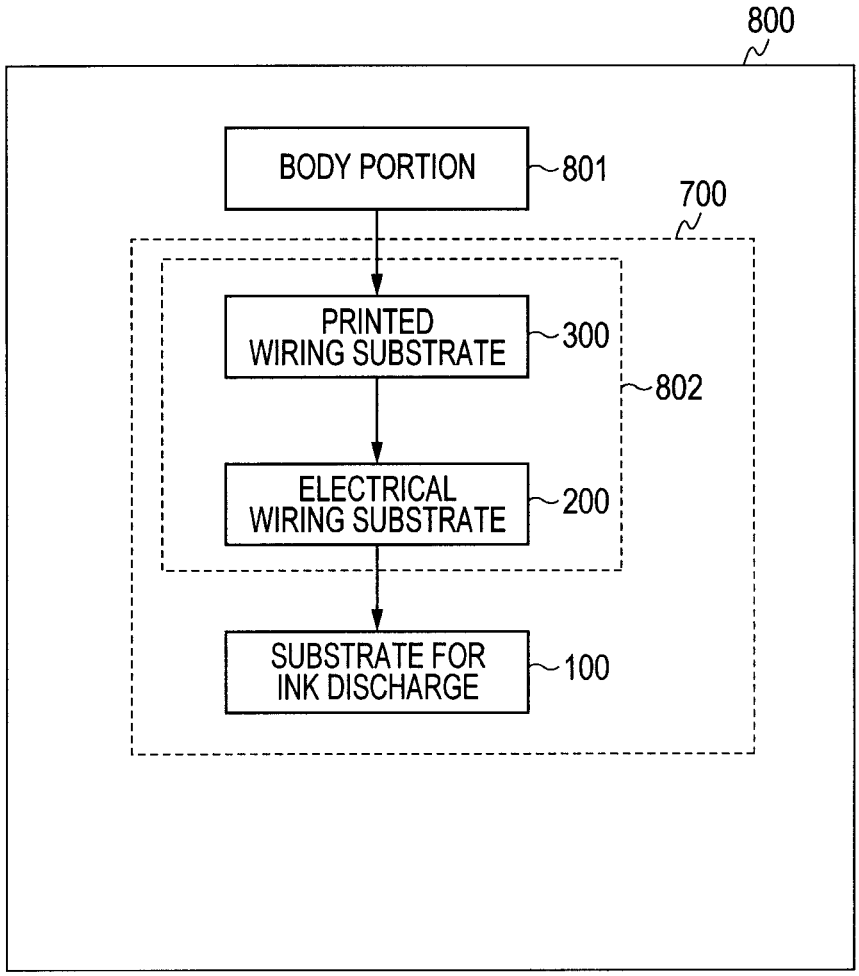
FIG. 1 is a block diagram illustrating an electric configuration of an ink jet recording apparatus of the present embodiment.

FIG. 1 is a block diagram illustrating an electric configuration of an ink jet recording apparatus of the present embodiment. As illustrated in FIG. 1, an ink jet recording apparatus 800 of the present embodiment has a liquid discharge head 700 which discharges ink, and a body portion 801 electrically connected to the liquid discharge head 700. The liquid discharge head 700 has a recording element substrate 100, and an electrical wiring member 802 electrically connected to the recording element substrate 100. The electrical wiring member 802 has an electrical wiring substrate 200 and a printed wiring substrate 300.

The recording element substrate 100 is electrically connected to the electrical wiring substrate 200. Additionally, connecting terminals are provided in the same shape on both the electrical wiring substrate 200 and a printed wiring substrate 300. Also, the electrical wiring substrate 200 and the printed wiring substrate 300 are electrically connected by thermocompression bonding through an ACF (Anisotropic Conductive Film) tape. Thereby, the recording element substrate 100 is electrically connected to the printed wiring substrate 300 through the electrical wiring substrate 200. Additionally, the recording element substrate 100 is electrically connected to the body portion 801 through the electrical wiring substrate 200 and the printed wiring substrate 300.

A flexible wiring substrate is used as the electrical wiring substrate 200 of the present embodiment. In this flexible wiring substrate, copper foil patterned after being bonded with an adhesive under a base film is used as electrical wiring. Also, this flexible wiring substrate includes electrode terminals electrically connected to a pad of the recording element substrate 100, and the printed wiring substrate 300, respectively. In addition, portions other than the electrode terminals are covered with cover films.

Additionally a rigid wiring substrate is used as the printed wiring substrate 300 of the present embodiment. This rigid wiring substrate has electrical wiring patterned on a glass epoxy substrate using copper, nickel, or gold, and a contact pad portion 330 for one of receiving electric power supply and receiving input of an electrical signal from the body portion 801, or the like (refer to FIG. 2).

Figure 2:
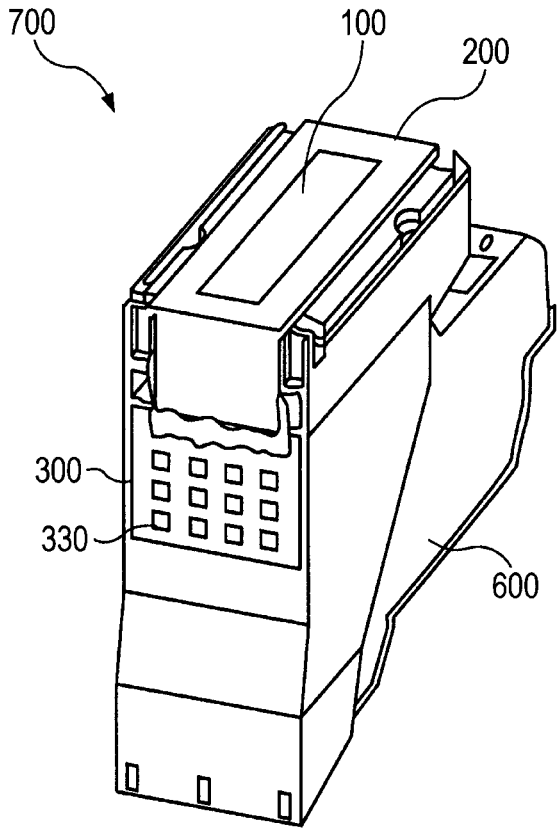
FIG. 2 is a perspective view illustrating the external appearance of a liquid discharge head of the present embodiment.

FIG. 2 is a perspective view illustrating the external appearance of the liquid discharge head 700.

As illustrated in FIG. 2, an electrical connection part with the recording element substrate 100 is provided on the electrical wiring substrate 200, and one end of the electrical wiring substrate 200 is electrically connected to the printed wiring substrate 300. The contact pad portion 330 used for the electrical connection with the body portion 801 is formed on the printed wiring substrate 300. In the present embodiment, the connection between the electrical wiring substrate 200 and the recording element substrate 100 and the connection between the electrical wiring substrate 200 and the printed wiring substrate 300 are implemented by ILB (Inner Lead Bonding) connection, respectively. Then, after each substrate is pasted on an ink holder 600, the electrical connection part of the electrical wiring substrate 200 is sealed with a sealing agent, thereby completing the liquid discharge head 700.

Figure 3:
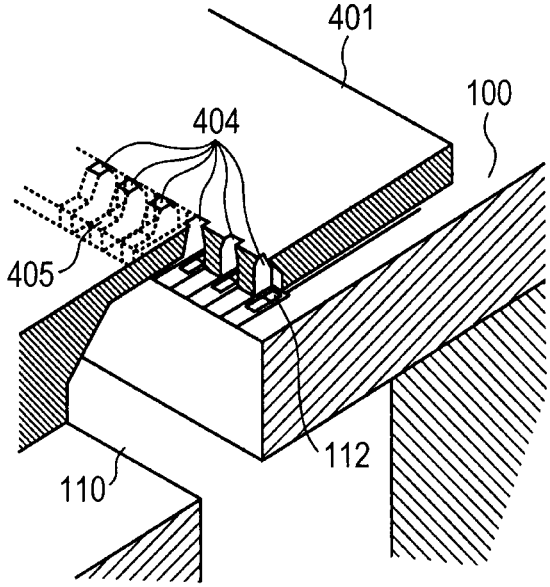
FIG. 3 is a perspective view illustrating a portion of the liquid discharge head illustrated in FIG. 2 in an enlarged manner.

FIG. 3 is a perspective view illustrating a portion of the liquid discharge head illustrated in FIG. 2 in an enlarged manner.

A plurality of heaters 111 (not illustrated in FIG. 3) and 112 is arranged along both sides of an ink supply port 110 on the recording element substrate 100. The ink supply port 110 is substantially rectangular, and is formed as a through hole which extends in the longitudinal direction of the recording element substrate 100, at the central part of the recording element substrate 100. The heat generating elements 111 and 112 generate heat when a current (a first current) flows, and heat the ink which has flowed in from the ink supply port 110 with this heat. Then, air bubbles are generated, and ink is discharged from discharge ports 404 formed in an orifice plate 401 by the air bubbles. The discharge ports 404 are provided at positions where the discharge ports face the heat generating elements 111 and 112, and communicate with the ink supply port 110 through flow channels 405. By connecting the orifice plate 401 to the recording element substrate 100, a common liquid chamber which communicates with the ink supply port 110 and supplies ink to each flow channel 405 is provided.

Figure 4:
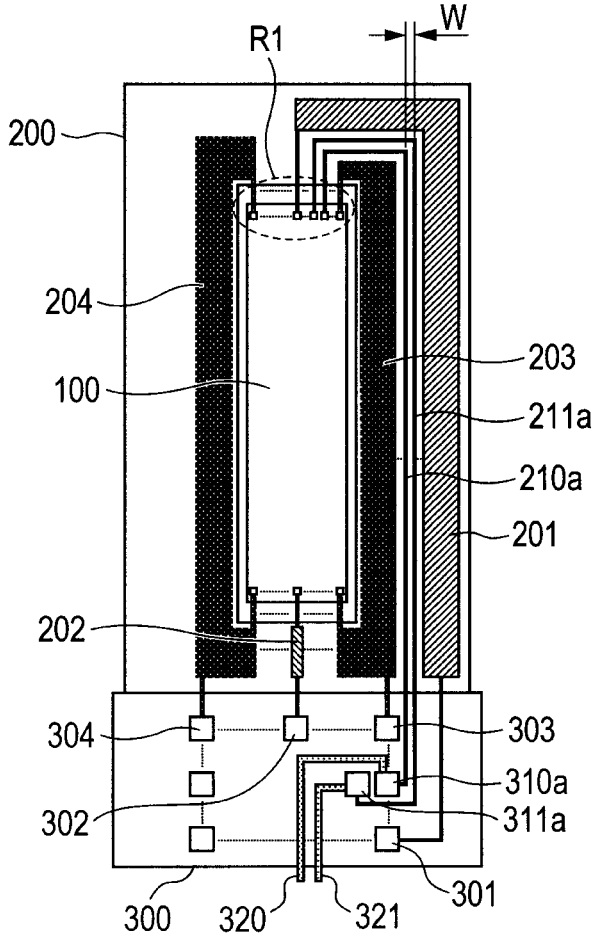
FIG. 4 is a plan view illustrating the configuration of chief parts of the liquid discharge head of the present embodiment.
Figure 5:
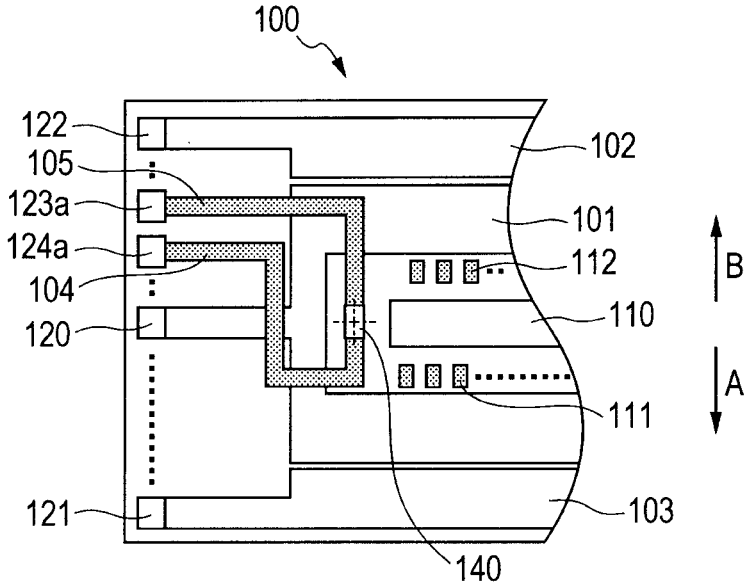
FIG. 5 is an enlarged view of a region R1 illustrated in FIG. 4.
Figure 6:
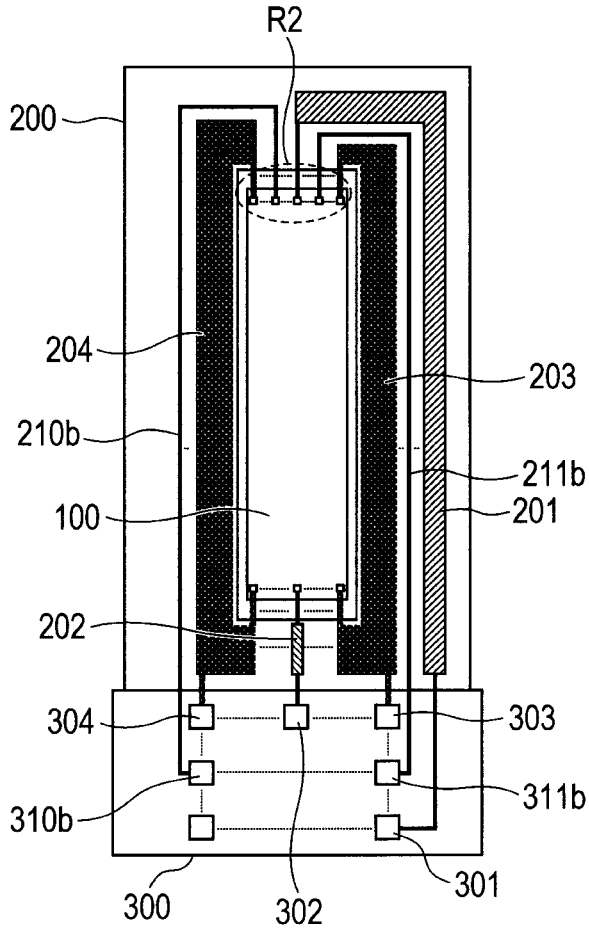
FIG. 6 is a plan view illustrating the configuration of chief parts of a liquid discharge head of a comparative example.
Figure 7:
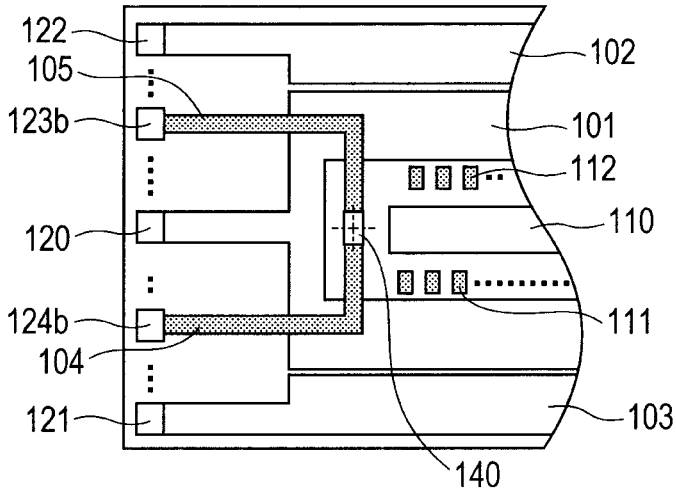
FIG. 7 is an enlarged view of a region R2 illustrated in FIG. 6.

FIG. 4 is a plan view illustrating the configuration of chief parts of the liquid discharge head of the present embodiment. FIG. 5 is an enlarged view of a region R1 illustrated in FIG. 4. A portion of a peripheral edge portion of the recording element substrate 100 is illustrated in an enlarged manner in FIG. 5. Additionally, FIG. 6 is a plan view illustrating the configuration of chief parts of a liquid discharge head of a comparative example with respect to the present embodiment. FIG. 7 is an enlarged view of a region R2 illustrated in FIG. 6. A portion of a peripheral edge portion of the recording element substrate of the comparative example is illustrated in an enlarged manner in FIG. 7.

As illustrated in FIGS. 4 and 6, in the present embodiment and the comparative example, the electrical wiring substrate 200 is formed with electrical power source lines 201 and 202 and grounding lines 203 and 204. Additionally, as illustrated in FIGS. 5 and 7, a temperature detecting element 140 which is close to the heat generating elements 111 and 112 and through which a current (a second current) is constantly flowing is provided. In the present embodiment, the temperature detecting element 140 is a diode. In addition, since the temperature detecting element 140 may have the characteristic that an output voltage for current changes in response to changes in the temperature of the heat generating elements 111 and 112, for example, the temperature detecting element may be formed from aluminum.

One end of the electrical power source line 201 or 202 is individually joined to a pad 301 or 302 for an electrical power source of the printed wiring substrate 300. The other end of the electrical power source line 201 or 202 is individually joined to a pad 120 for an electrical power source of the recording element substrate 100. One end of the grounding line 203 or 204 is individually joined to a pad 303 or 304 for grounding of the printed wiring substrate 300. The other end of the grounding line 203 or 204 is individually joined to a pad 121 or 122 for grounding of the recording element substrate 100.

In the present embodiment, one end of each of a pair of lines 210*a* and 211*a* for temperature detection is individually joined to each of a pair of pads 310*a* and 311*a* for temperature detection of the printed wiring substrate 300 (refer to FIG. 4). The other end of each of the pair of lines 210*a* and 211*a* for temperature detection is individually joined to each of a pair of electrode pads 123*a* and 124*a* of the recording element substrate 100. As illustrated in FIG. 5, in the recording element substrate 100, each of the pair of electrode pads 123*a* and 124*a* is electrically connected to the other through the temperature detecting element 140. Specifically, the electrode pad 123*a* is electrically connected to an anode of the temperature detecting element 140 through electrical line 105, and, the electrode pad 124*a* is electrically connected to a cathode of the temperature detecting element 140 through electrical line 104.

On the other hand, even in the comparative example, one end of each of a pair of lines 210*b* and 211*b* for temperature detection is individually joined to each of a pair of pads 310*b* and 311*b* for temperature detection of the printed wiring substrate 300 similarly to the present embodiment (refer to FIG. 6). The other end of each of the pair of lines 210*b* and 211*b* for temperature detection is individually joined to each of a pair of electrode pads 123*b* and 124*b* of the recording element substrate 100.

In addition to the configuration as described above, a line pattern with a thickness of 25 μm is formed using copper foil on a base film with a width of 15 mm and a length of 50 mm in the electrical wiring substrate 200 illustrated in FIGS. 4 and 6, respectively. The widths of the electrical power source lines 201 and 202 and the grounding lines 203 and 204 which are formed in the electrical wiring substrate 200 are a minimum of 30 μm and a maximum of 1500 μm, respectively. Additionally the width of the pair of lines 210*a* and 211*a* for temperature detection, the width of the pair of lines 210*b* and 211*b* for temperature detection, and the width of the other logic lines (not illustrated) are uniformly 30 μm. In that case, the gaps between the respective lines and a contact pad portion 330 are a minimum of 50 μm and a maximum of 300 μm. In addition, in the electrical wiring substrate 200 of the present embodiment, the width between each of the pair of lines 210*a* and 211*a* for temperature detection and the width between each of the pair of lines 210*b* and 211*b* for temperature detection are 50 μm in the vicinity of connection parts with the recording element substrate 100. Additionally, the width W (distance between mutually facing ends of the pair of lines 210*a* and 211*a* for temperature detection) between the pair of lines 210*a* and 211*a* for temperature detection in the other places is within a range from 10 μm to 150 μm (refer to FIG. 4).

Additionally, in the printed wiring substrate 300 illustrated in FIGS. 4 and 6, respectively, a line pattern with a thickness of 20 μm is formed and laminated using copper foil on both sides of a glass epoxy substrate with a width of 20 mm and a length of 20 mm. Additionally a through hole with a thickness of 25 μm is formed, and electrically connects the laminated substrates together. The widths of the electrical power source line 201 and 202 and the grounding line 203 and 204 which are provided in the printed wiring substrate 300 are a minimum of 100 μm and a maximum of 2500 μm, respectively. Additionally the width of the pair of lines 210*a* and 211*a* for temperature detection, the width of the pair of lines 210*b* and 211*b* for temperature detection, and the width of the other logic lines (not illustrated) are uniformly 100 μm. The gaps between the respective lines are a minimum of 100 μm and a maximum of 500 μm. In addition, in the printed wiring substrate 300 of the present embodiment, the width between each of a pair of lines 210*a* and 211*a* for temperature detection is 150 μm in the vicinity of connection parts with the electrical wiring substrate 200. Additionally, the width between each of the pair of lines 210*a* and 211*a* for temperature detection in the other places is within a range from 10 μm to 150 μm. As a result, in the present embodiment, even in the printed wiring substrate 300, each of the pair of pads 310*a* and 311*a* for temperature detection is arranged adjacent to the other. In addition, the size of the contact pad portion 330 is 2500×2500 μm. The contact pad portion 330 is formed by forming a pattern with a thickness of 30 μm using nickel, and then patterning copper foil with a thickness of 0.2 μm on this pattern.

In the present embodiment illustrated in FIG. 5, the pad 120 for an electrical power source and the line 101 connected thereto, the pads 121 and 122 for grounding and the lines 103 and 102 connected thereto, respectively, and the pair of electrode pads 123*a* and 124*a* are arranged at the peripheral edge portion of the recording element substrate 100. Each of the pair of electrode pads 123*a* and 124*a* is arranged adjacent to the other between the pad 120 for an electrical power source and the pad 122 for grounding, which are arranged apart from each other. Therefore, as illustrated in FIG. 4, in the electrical wiring substrate 200, each of the pair of lines 210*a* and 211*a* for temperature detection is adjacent to the other between the electrical power source line 201 and the electrical power source line 202.

On the other hand, in the comparative example illustrated in FIG. 7, each of the pair of pads 123*b* and 124*b* for temperature detection is arranged apart from the other with the pad 120 for an electric power source therebetween. Therefore, as illustrated in FIG. 6, in the electrical wiring substrate 200, one line 210*b* for temperature detection is arranged outside the grounding line 204, and the other line 211*b* for temperature detection is arranged between the electrical power source line 201 and the electrical power source line 202. That is, in the comparative example, each of a pair of lines 210*b* and 211*b* for temperature detection is not adjacent to the other.

Figure 8:
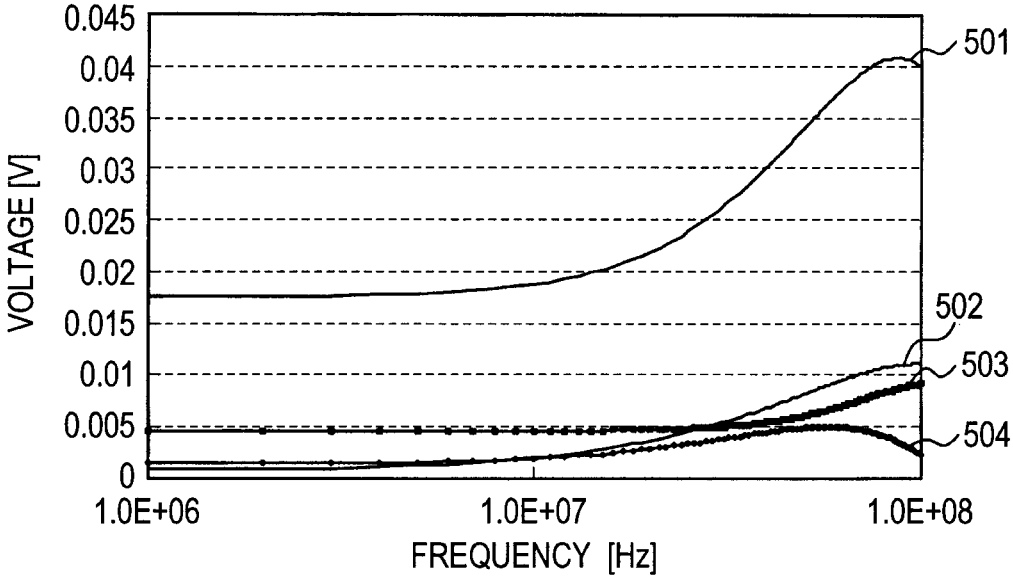
FIG. 8 is a graph illustrating comparison results of the noise voltage of a temperature detecting element between the present embodiment and the comparative example.

Here, in the above-described two kinds of liquid discharge heads, a current of 0.5 A is fed respectively from the pads 301 and 302 for an electrical power source of the printed wiring substrate 300, thereby performing bidirectional recording. Here, the bidirectional recording means records while moving the liquid discharge head in a first direction (refer to an arrow A of FIG. 5) which moves toward the heat generating elements 111 from the heat generating elements 112 and in a second direction (refer to an arrow B of FIG. 5) which moves toward the heat generating elements 112 from the heat generating elements 111. When the liquid discharge head is moved in the first direction, a current for applying a current to the heat generating elements 111 is supplied from the body portion 801. This current flows through the electrical power source line 201 through the electrical power source pad 301 from the body portion 801. Subsequently, this current flows to the grounding line 204 through the heat generating elements 111 from the electrical power source line 201. When the liquid discharge head is moved in the second direction, a current for applying a current to the heat generating elements 112 is supplied from the body portion 801. This current flows through the electrical power source line 201 through the electrical power source pad 301 from the body portion 801. Subsequently, this current flows to the grounding line 203 through the heat generating elements 112 from the electrical power source line 201. In addition, the body portion 801 applies a current to the temperature detecting element 140 through the pair of lines 210*a* and 211*a* for temperature detection, while applying a current to the heat generating elements 111 and 112. As for the noise voltage of the temperature detecting element 140 at this time, the comparison results between the present embodiment and the comparative example are illustrated in FIG. 8. In the graph of FIG. 8, the noise voltage of the temperature detecting element 140 is Fourier-transformed, and is illustrated in the relationship with frequency. In FIG. 8, a curve 501 represents the noise voltage in a case where a current is applied to only the heat generating elements 111 in the configuration of the comparative example. A curve 502 represents the noise voltage in a case where a current is applied to only the heat generating elements 112 in the configuration of the comparative example. A curve 503 represents the noise voltage in a case where a current is applied to only the heat generating elements 111 in the configuration of the present embodiment. A curve 504 represents the noise voltage in a case where a current is applied to only the heat generating elements 112 in the configuration of the present embodiment.

In a case where a current is applied only to the heat generating elements 111, in the comparative example, noise voltages are generated in the pair of lines 210*b* and 211*b* for temperature detection under the influence of current application of the electrical power source line 201 and the grounding line 204. On the other hand, in the present embodiment, noise voltages are generated in the pair of lines 210*a* and 211*a* for temperature detection under the influence of current application of the electrical power source line 201. In the present embodiment, in the electrical wiring substrate 200, each of the pair of lines 210*a* and 211*a* for temperature detection is adjacent to the other. Therefore, each of the pair of lines 210*a* and 211*a* for temperature detection receives noise respectively emitted from the electrical power source line 201 and the grounding lines 203 and 204 in the same environment (positions) as the other. Particularly, in a case where the overall lengths of the pair of lines 210*a* and 211*a* for temperature detection are the same (including a case where the overall lengths are substantially the same), noise voltages generated in the pair of lines 210*a* and 211*a* for temperature detection, respectively, become the same magnitude. At this time, since noise currents which flow through the lines 210*a* and 211*a* for temperature detection, respectively, have reverse phases as seen from the temperature detecting element 140, the noise currents are mutually cancelled out. For this reason, when the noise voltage curves 501 and 503 are compared with each other, it is found that the configuration of the present embodiment reduces noise voltages compared to the configuration of the comparative example.

In a case where a current is applied to only the heat generating elements 112, in the comparative example, as currents flows through the electrical power source line 201 and the grounding line 203, a noise voltage is generated in the line 211*b* for temperature detection. At this time, since currents flow through the electrical power source line 201 and the grounding line 203 which are arranged with the line 211*b* for temperature detection therebetween in mutually opposite directions, a noise voltage generated in the line 211*b* for temperature detection arranged therebetween is reduced compared to a case where a current is applied to only the heat generating elements 111. For this reason, a noise voltage (refer to curve 503) when a current is applied to only the heat generating elements 112 is reduced compared to the noise voltage (refer to the curve 501) in a case where a current is applied to only the heat generating elements 111.

Similarly, even in the present embodiment, currents flow through the electrical power source line 201 and the grounding line 203 which are arranged alongside each other with the pair of lines 211*a* and 210*a* for temperature detection therebetween in mutually opposite directions. Therefore, the noise voltages are cancelled out. Moreover, in the present embodiment, each of the pair of lines 211*a* and 210*a* for temperature detection is arranged in parallel to the other. Therefore, it is found that the noise voltages (refer to the curve 504) are reduced compared to the noise voltages (refer to curve 502) of the comparative example.

Through the configuration in which each of the pair of lines 210*a* and 211*a* for temperature detection is arranged adjacent to the other as described above, the noise voltages of the temperature detecting element 140 are reduced compared to those of the configuration in which each of the pair of lines 210*b* and 211*b* for temperature detection is not arranged adjacent to the other. Specifically, it is found that the difference between the noise voltages is reduced to ¼ to ⅕ of the comparative example (refer to FIG. 8).

Additionally, in the present embodiment, in the printed wiring substrate 300, each of the pair of pads 310*a* and 311*a* for temperature detection is arranged adjacent to the other. Therefore, it is possible to arrange each of the pair of electrical lines 320 and 321 (refer to FIG. 4), which electrically connect the pair of pads 310*a* and 311*a* for temperature detection and the body portion 801, in parallel to the other. Thereby, there is an effect of reducing even the noise of electrical lines outside the liquid discharge head 700. In addition, the pair of electrical lines 320 and 321 is formed in a flexible wiring substrate (not illustrated). One end of each of the electrical lines is connected to the body portion 801 and the other end thereof is individually joined to each of the pair of pads 310*a* and 311*a* for temperature detection.

Figure 9:
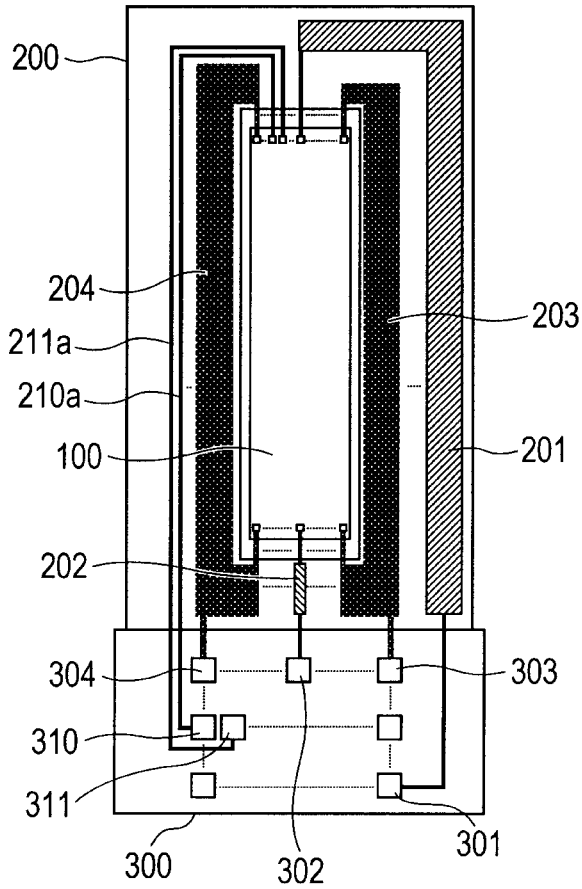
FIG. 9 is a plan view illustrating another embodiment of the liquid discharge head of the invention.

In addition, the present embodiment provides the configuration in which the pair of lines 210*a* and 211*a* for temperature detection is arranged between the electrical power source line 201 and the grounding line 203. However, the invention is not limited to this configuration. For example, a configuration in which the pair of lines 210*a* and 211*a* for temperature detection is arranged outside the grounding line 204 may be adopted as illustrated in FIG. 9. Even in this configuration, the noise voltage of the temperature detecting element 140 is reduced by arranging each of the pair of lines 210*a* and 211*a* for temperature detection adjacent to the other.

Additionally, the present embodiment provides the configuration in which the number of openings of the ink supply port 110 is one, and the heat generating elements 111 and 112 are arranged on both sides of each opening. However, the present invention may provide a configuration in which the ink supply port 110 is formed with a plurality of openings, and the heat generating elements 111 and 112 are arranged on both sides of each opening.

Additionally, in the present embodiment, each of the pair of pads 310*a* and 311*a* for temperature detection is arranged adjacent to the other in the longitudinal direction of the printed circuit board 300 on the printed circuit board 300. However, in the invention, the pads for temperature detection may be arranged adjacent to each other in the lateral direction.

Figure 10:
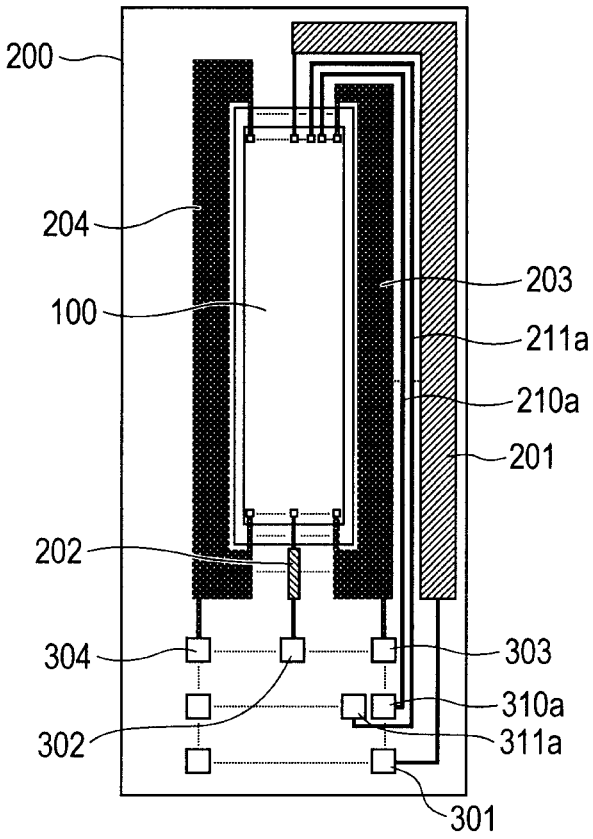
FIG. 10 is a plan view illustrating another embodiment of the ink jet recording apparatus of the invention.

Moreover, in the present embodiment, as illustrated in FIG. 10, a configuration in which the printed wiring substrate 300 is integrated with the electrical wiring substrate 200 may be adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-125113, filed May 31, 2010, which is hereby incorporated by reference herein in its entirety.

What is claimed is:

1. A liquid discharge head comprising:

a recording element substrate which includes a heat generating element which generates heat energy used to discharge a liquid and a temperature detecting element for detecting a temperature of the recording element substrate; and an electrical wiring member which includes an electrical power source line and a grounding line electrically connected to each other through the heat generating element to apply a current to the heat generating element, and a pair of lines for temperature detection electrically connected to each other through the temperature detecting element, wherein each of the pair of lines for temperature detection is arranged adjacent to the other, and additional wiring is not provided between each of the pair of lines for temperature detection.

2. The liquid discharge head according to claim 1, wherein the recording element substrate includes a pair of electrode pads, each electrode pad individually connects one end of each of the pair of lines for temperature detection, and the temperature detecting element, and each of the electrode pads is arranged adjacent to the other.

3. The liquid discharge head according to claim 2, wherein the electrical wiring member has an electrical wiring substrate electrically connected to the recording element substrate, and a printed wiring substrate electrically connected to the recording element substrate through the electrical wiring substrate.

4. The liquid discharge head according to claim 3, wherein the printed wiring substrate includes a pair of pads for temperature detection to which the other end of each of the pair of lines for temperature detection is individually joined, and each of the pads for temperature detection is arranged adjacent each other.

5. The liquid discharge head according to claim 1, wherein the respective overall lengths of the pair of lines for temperature detection are substantially the same.

6. An ink jet recording apparatus comprising:

a liquid discharge head according to claim 1; and a body portion electrically connected to the liquid discharge head, wherein the body portion applies a current to the heat generating element through the electrical power source line and the grounding line while applying a current to the temperature detecting element through the pair of lines for temperature detection, thereby detecting the output voltage of the temperature detecting element.

7. The ink jet recording apparatus according to claim 6, further comprising a pair of electrical lines electrically connecting the body portion and each of the pair of lines for temperature detection, and each of the electrical lines is arranged adjacent each other.

8. The liquid discharge head according to claim 1, wherein an electrical current flows in each of the pair of lines in opposite directions for temperature detection.

9. The liquid discharge head according to claim 1, wherein the pair of lines for temperature detection is provided between the electrical power source line and the grounding line.

* * * * *